US005596358A

United States Patent [19]

Hunt et al.

[11] Patent Number: 5,596,358

[45] Date of Patent: Jan. 21, 1997

[54] METHOD AND APPARATUS FOR REFILLING A PRINT CARTRIDGE HAVING A RESERVOIR PRESSURE OF LESS THAN AMBIENT PRESSURE

[75] Inventors: David S. Hunt; Jon J. Fong; Joseph E. Scheffelin, all of San Diego; Alfred U. N. Zepeda, San Marcos, all of Calif.

[73] Assignee: Hewlett-Packard Company, Palo Alto, Calif.

[21] Appl. No.: 332,010

[22] Filed: Oct. 31, 1994

[51] Int. Cl.[6] ..... B41J 2/175

[52] U.S. Cl. ..... 347/85

[58] Field of Search ..... 347/85, 86, 87; 141/27

[56] References Cited

U.S. PATENT DOCUMENTS 4,750,532 6/1988 Grothoff ..... 141/27
4,967,207 10/1990 Ruder ..... 347/87
5,119,115 6/1992 Buat et al. ..... 347/86
5,400,573 3/1995 Crystal et al. ..... 347/87

FOREIGN PATENT DOCUMENTS 488829 6/1992 European Pat. Off. ..... 347/87

*Primary Examiner*—N. Le

[57] ABSTRACT

Apparatus and method for refilling print cartridges for computer controlled printers. The apparatus creates a closed system that is isolated from ambient pressure. The apparatus utilizes both a vacuum in the ink reservoir in the print cartridge and vertical displacement of the refill reservoir with respect to the reservoir in the print cartridge to draw refill ink into the print cartridge to an operating level and to an operating pressure of less than ambient pressure. Within this closed system the apparatus dislodges the closure on the print cartridge and reseats a replacement closure during refilling.

9 Claims, 4 Drawing Sheets

METHOD AND APPARATUS FOR REFILLING A PRINT CARTRIDGE HAVING A RESERVOIR PRESSURE OF LESS THAN AMBIENT PRESSURE

FIELD OF INVENTION

The present invention generally relates to print cartridges that are received in computer controlled printers and, more particularly, to methods and apparatus for refilling such print cartridges.

BACKGROUND OF THE INVENTION

Printers are devices that print characters onto a printing medium such as paper or polyester film and are commonly controlled by a computer that supplies the image in the form of print commands. Some printers use a colorant-containing liquid which may be either a dye or a polymer. These liquids are termed "ink" in the printer industry. The printer forms images on the printing medium by delivering ink to the medium using a print head that creates the proper patterns of ink to record the image permanently.

One type of printer is the ink-jet printer which forms a small droplets of ink that are ejected toward the printing medium in a precise pattern of dots. When viewed at a distance, the collection of dots forms the image in much the same manner as photographic images are formed in newspapers. Ink-jet printers are fast, produce high quality printing, and are quiet because there is no mechanical impact during operation.

Typically, an ink-jet printer has a large number of individual ink nozzles that are arranged in arrays in the print head. The print head is supported in a carriage, and the ink nozzles are oriented in a facing, but spaced apart, relationship to the printing medium. The carriage and the printhead traverse over the surface or the medium again and again with the nozzles ejecting droplets of ink at appropriate times under the command of the computer. After each transverse by the print head, the printing medium is moved an increment in the direction lateral to the transverse and thereafter the carriage with the print head traverses the page again to deposit another swath. In this manner the entire pattern of dots that forms the image is progressively deposited one swath at a time by the print head.

In a thermal ink-jet printer the ejection of droplets is accomplished by heating a small volume of ink adjacent the nozzle, vaporizing a bubble of ink, and thereby driving a droplet of ink through the nozzle toward the printing medium. The droplets strike the medium and then dry to form "dots" that, when viewed together, form one swath of the permanently printed image.

In some types of printers the ink is stored in a reservoir that is mounted on the carriage along with the print head. Ink is then delivered by capillary action to the nozzles. In these printers the print head is a single-use, consumable, disposable unit that may be readily inserted and removed from the printer when the ink reservoir is exhausted. One such printer and the print cartridges for it are described in *Hewlett-Packard Journal*, February 1994, Volume 45, Number 1.

In the early stages of the development of thermal ink-jet printers, the useful life of a print head was usually determined by the length of time until the first nozzle failed. More recently the design of nozzles and print heads has so advanced that the life of the nozzles prior to failure has significantly lengthened. In other words, the supply of ink in a reservoir may now be exhausted before a nozzle failure is experienced. Thus, there now exists a need for a larger supply of ink to be available for print cartridges because of the extended nozzle life.

Simply increasing the size of the ink reservoir has not proved to be an acceptable solution however. Typically, a reservoir is supported on the printer carriage and moves with the print head. Increasing the size of the reservoir would necessarily increase the size and weight of the structure that supports and moves the carriage back and forth. This would cause the performance of the printer to suffer because of the increased mass of the carriage and would also significantly increase the cost of the printer.

Still another solution would seem to be to refill the empty print cartridges with replenishment ink. This would allow the print heads to be used again and again until nozzle failure. As of yet this approach has not proven to be reliable or satisfactory because of at least four significant problems.

The first problem and probably the most significant from the operator's point of view is how to transfer ink from a replenishment ink reservoir to the print cartridge while avoiding spillage and leakage. No operator wants to have his or her hands, clothing, or work areas stained by spilled ink.

The second problem is maintaining the operating pressure in the print cartridge during the next operating cycle. Normally, print cartridges operate at a pressure of approximately two inches of water below atmospheric pressure (3.74 torr), and the ink is supplied to the nozzles at this pressure by capillary action. In some print cartridges the pressure of the ink in the reservoir is maintained by a collapsible ink bag and a spring which urges the walls of the ink bag apart against atmospheric pressure. If the pressure of the ink exceeds a maximum level, ink will be forced out of the nozzles and the print cartridge will "drool" ink onto the paper and into the printer. If the pressure of the ink in the print cartridge drops below a minimum level, the flow of ink to the nozzles will stop because the capillary pressure is exceeded.

A third problem is maintaining the pressure of the ink in the print cartridge during refilling. If the pressure of the ink exceeds a maximum level during refilling, then ink will drool from the nozzles and leakage will occur. If the pressure in the print cartridge drops below a minimum level, then air may be drawn into the nozzles which may block the passage of ink and cause nozzle failure.

A fourth problem is the inadvertent introduction of air or gases into the print cartridge during replenishment. If bubbles are entrapped in the print cartridge during replenishment, these bubbles can travel within the print cartridge and block the narrow passage ways leading to the print nozzles and thereby cause nozzle failure.

It will be apparent from the foregoing that although there are many processes and apparatus for refilling print cartridges, there is still a need for an approach that avoids spillage and leakage and properly maintains the pressure within the print cartridge during refilling and the next operating cycle.

SUMMARY OF THE INVENTION

The present invention provides an apparatus for refilling a print cartridge that is easy to operate, simple to use, and maintains the print quality of the original cartridge. The apparatus will allow an operator to "top-off" a print cartridge at any time and to refill a print cartridge before it is empty.

Briefly and in general terms, an apparatus according to the present invention includes a refill ink reservoir having a pressure in excess of the pressure in the ink reservoir of the print cartridge, an ink conduit connected to the refill ink reservoir and connectable to the ink reservoir in the print cartridge; a closure dislocater for opening the ink reservoir of the print cartridge; a replacement closure positioner for closing the ink reservoir of the print cartridge; and closed system for sealing the refill ink reservoir, the ink conduit, and the ink reservoir of the print cartridge against ambient pressure so that the print cartridge is refillable by the excess pressure in the refill ink reservoir.

The process of the present invention includes establishing fluid communication between a refill ink reservoir and a ink reservoir in a print cartridge with an ink conduit; isolating the refill ink reservoir, the reservoir in the print cartridge and the ink conduit from ambient pressure; and equalizing pressure to thereby transfer ink from the refill ink reservoir to the ink reservoir in the print cartridge, said refill ink reservoir having a pressure in excess of the pressure in the ink reservoir in the print cartridge.

Other aspects and advantages of the invention will become apparent from the following detailed description, taken in conjunction with the accompanying drawings, illustrating by way of example the principles of the invention.

DESCRIPTION OF THE PREFERRED EMBODIMENT

In summary, the apparatus refills a print cartridge that has a vacuum in its ink reservoir. A refill ink reservoir is positioned below the print cartridge and is connected to it to form a closed system isolated from ambient pressure. The vacuum in the print cartridge draws the refill ink up and into its reservoir. The apparatus is vertically dimensioned so that the print cartridge is refilled to its operational level and returned to its operational back pressure.

Figure 1:
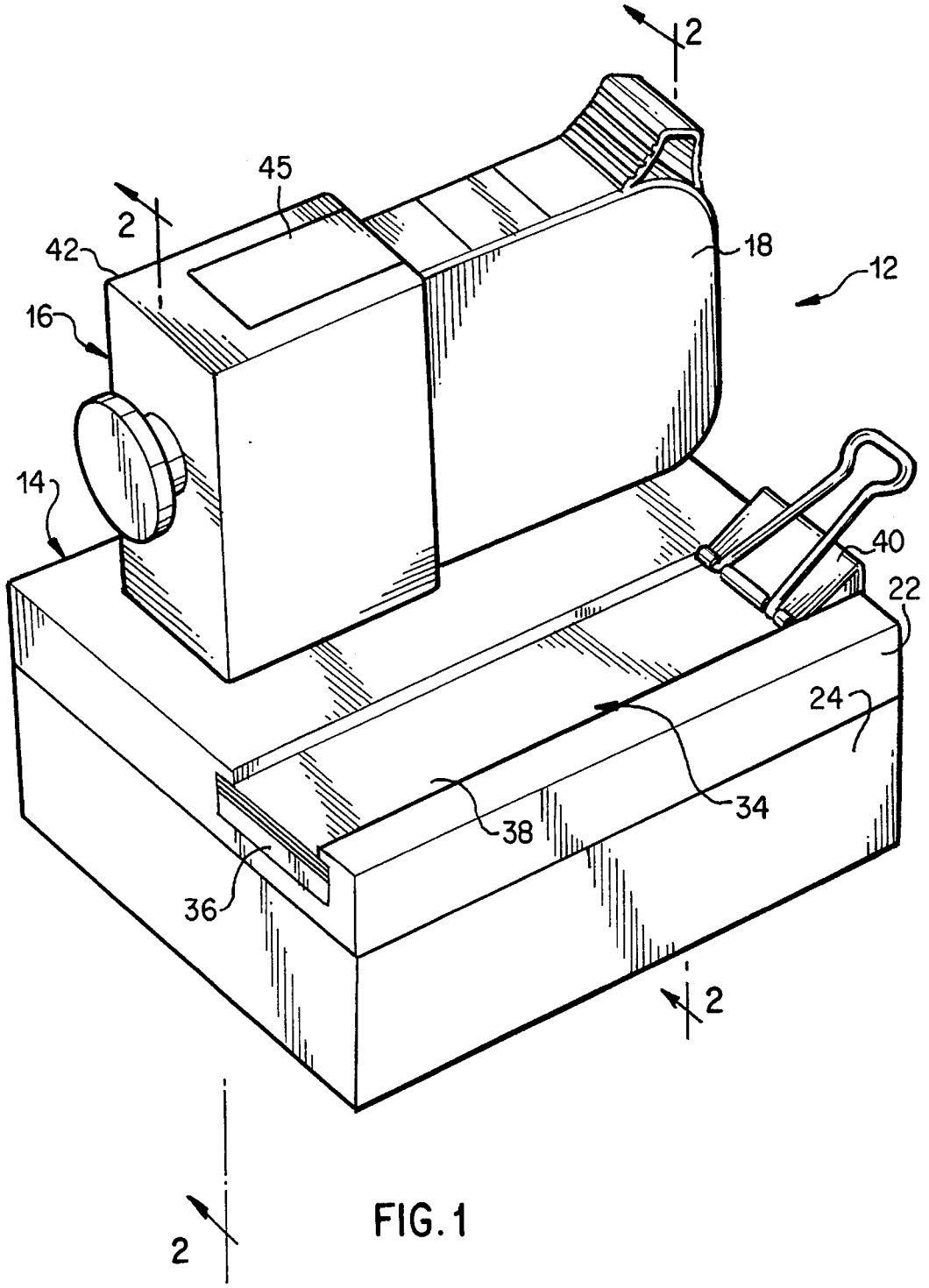
FIG. 1 is a perspective view of the apparatus for refilling print cartridges according to the present invention.

Referring to FIG. 1, reference numeral 12 generally indicates an apparatus for refilling print cartridges. The apparatus comprises a base 14 and an ink loading assembly 16. Also illustrated in FIG. 1 is a print cartridge 18. The print cartridge has an ink reservoir 19, FIG. 2, that is sealed by a closure 20, FIG. 3, having the shape of sphere. The ink reservoir has an initial operating pressure of about −2 to −3 inches of water and when refilling is required, has a pressure of about −7 to −9 inches of water. It should be appreciated that when refilling is required, the print cartridge is not empty of ink and contains a sufficient quantity of ink to maintain a vacuum. A further description of print cartridges can be found in the *Hewlett-Packard Journal* cited above. Although any print cartridge having the necessary mechanical characteristics can be used, it is intended that the apparatus 12 be preferably used to refill Hewlett-Packard model 51640 and 51650 print cartridges that are available from the Hewlett-Packard Company of Palo Alto, Calif., USA.

Figure 2:
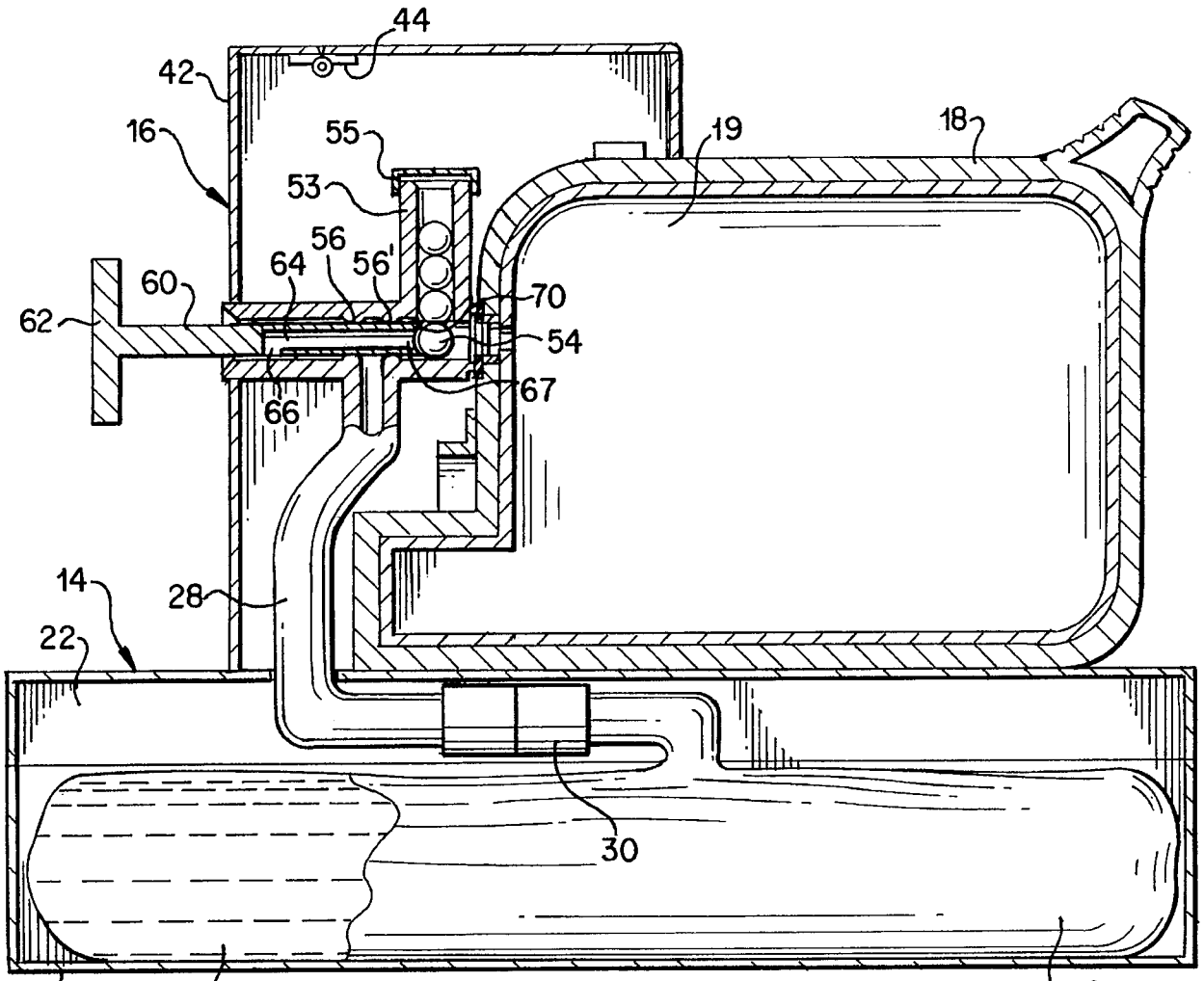
FIG. 2 is a side elevational view, in section, taken along plane 2—2 of the apparatus of FIG. 1.

The base 14, FIGS. 1 and 2, includes a top case 22 and a bottom case 24. The top and bottom cases are rectangular in shape, hollow in section, snap together, and contain an ink bag 26 filled with refill ink 27. The cases separate in order to allow replacement of the ink bag when it is empty. The ink bag is a deformable, sealed, polyethylene container at atmosphere pressure. The refill ink is of substantially the same quality and type as the ink that originally came from the print cartridge manufacturer. The ink bag terminates into an ink conduit 28 and a mechanical coupling 30 for replacing the ink bag. The conduit is flexible and both the conduit and the coupling seal the ink reservoir from ambient pressure.

Referring to FIG. 1, the base 14 further includes a cartridge wiper 34 for removing the build-up of debris on the print head (not shown) that occurs during operation of the print cartridge 18. The cartridge wiper includes an elastomeric pad 36 and a plurality of wiper pads 38 that are retained in the base by a clip 40. The elastomeric pad provides a deformable surface that conforms to the shape of the print head during wiping. The wiper pads are made from an absorbent cotton medium and each is pre-wetted with de-ionized water. Each wiper pad is contained in a vapor proof protected pouch so the water does not evaporate prior to use. The pouch is opened prior to use.

Figure 3:
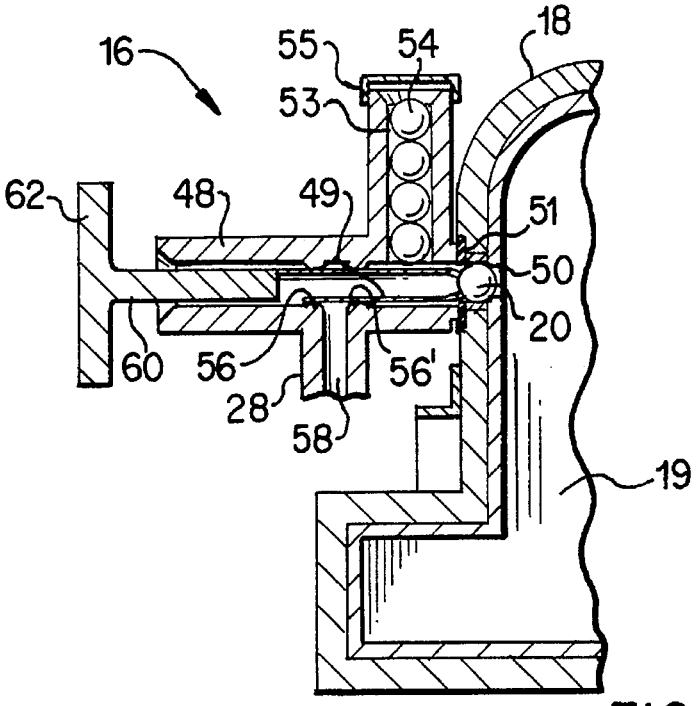
FIGS. 3–6, inclusive, are side elevational views in section of the apparatus indicated in FIG. 2.

The ink loading assembly 16, FIG. 2, has a housing 42 that surrounds the apparatus. The housing has a hinge 44 and an access door 45, FIG. 1 to the interior of the housing. Within the housing 42, FIGS. 2 and 3 is a hollow cylinder 48 having a bore 49. The distal end of the cylinder engages a refill port 50 and a seal 51 on the print cartridge 18. The refill port is sealed by the spherical closure 20 and the seal 51 within the refill port. The hollow cylinder further includes a vertical magazine 53 that stores a plurality of replacement closures 54. The magazine 53 is sealed against ambient pressure by a removable cap 55 located on the top of the magazine. The closures are fed into the breach of the cylinder as illustrated in FIG. 2. The hollow cylinder has two circular lands 56, 56' within its bore 49. These two lands are located on either side of an inlet port 58 to the hollow cylinder. The conduit 28 from the ink bag 26 connects to the inlet port and establishes fluid communication between the ink bag and the bore 49 of the hollow cylinder.

Figure 4:
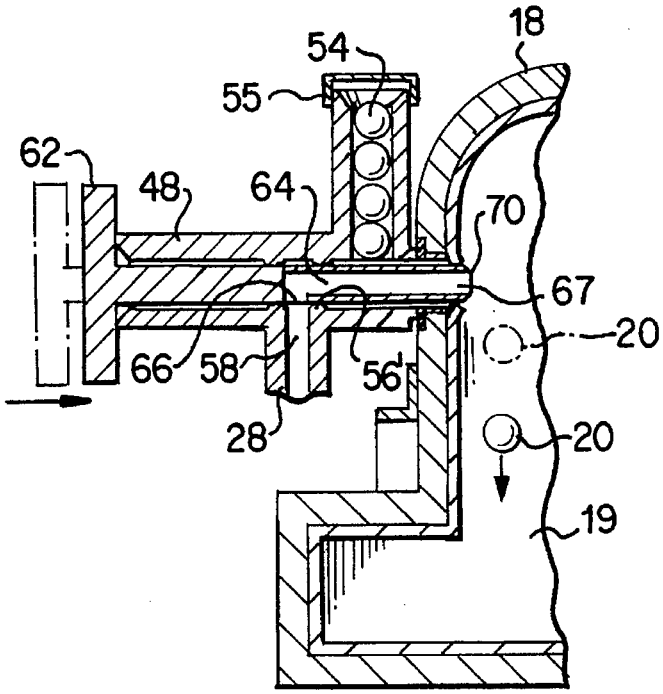

Referring to FIG. 2, the hollow cylinder 48 receives and guides an elongate ram 60 that dislocates and seats the spherical closures in the refill port 50 of the print cartridge. The ram has a handle 62 at one distal end so that it can be moved back and forth in a reciprocal motion with respect to the hollow cylinder. At the other distal end of the ram is a conduit 64 within the ram. The conduit communicates with the bore of the hollow cylinder through a side port 66 and an end port 67. As illustrated in FIG. 4, the side port of the ram can be brought into fluid communication with the inlet port 58 to the hollow cylinder. Also as described below the end port of the ram can be brought into fluid communication with the ink reservoir 19 of the print cartridge. The end wall of the end port 67 of the ram has a concave tip 70 to conform to the spherical shape of the closures.

It should be appreciated that a sealed ink transfer system, closed against ambient pressure, is established and maintained between the refill ink reservoir 26 and the ink reservoir 19 within the print cartridge 18. This system is sealed by the lands 56, 56' on the hollow cylinder 48, the cap 55 on the vertical magazine 53, and the seal 51 around the refill port 50 of the print cartridge. The system is sealed against ambient pressure so that the closure 20 of a print cartridge can be dislocated, the print cartridge reservoir can be refilled with ink, a replacement closure can be positioned before the ram and seated by it in the print cartridge, and the print cartridge returned to its operating pressure while a vacuum is maintained in the system. In addition, a sealable loader 72 for positioning the replacement closures in front of the ram is also formed by the lands 56, 56' on the hollow cylinder 48, the cap 55 on the vertical magazine 53, and the seal 51 around the refill port 50 of the print cartridge.

It should be further appreciated that the base 14 and the ink loading assembly 16 act as a locating fixture so that the refill ink reservoir, the ink bag 26, is located a predetermined distance below the ink reservoir 19 in the print cartridge 18. This distance is empirically determined so that the print cartridge after being refilled is returned to its operating pressure of about −2 to −3 inches of water. In embodiments of the apparatus actually tested, this distance was found to be between about 2 to 3 inches.

The operation of the apparatus is illustrated in FIGS. 3–6 inclusive. In FIG. 3 the seal 51 on the refill port 50 of the print cartridge 18 has been brought up into sealed contact with the ink loading assembly 16. The pressure within the ink reservoir 19 of the print cartridge 18 is about −7 to −9 inches of water. This vacuum is sufficient to cause print quality difficulties and necessitate refilling of the cartridge. As stated above, the cartridge is not empty of ink, however. The pressure in the ink bag is atmospheric although the bag is sealed to ambient pressure. The original spherical closure 20 for the refill port 50 is in place in the side wall of the print cartridge, and the ink conduit 28 and inlet port 58 are sealed by the position of the ram 60.

In FIG. 4 the handle 62 of the ram is inserted into the hollow cylinder 48 toward the print cartridge 18. The concave tip 70 on the distal end of the ram engages the closure 20 and dislocates it into the ink reservoir 19. The side port 66 on the ram is also brought up into fluid communication with the ink conduit 28 and the inlet port 58. This motion opens the ink flow path from the ink bag 26, through the conduit 64 of the ram, to the ink reservoir 19 within the print cartridge. Ink flows upward because the pressure in the ink bag 26, the refill reservoir, is at atmospheric pressure and is in excess of that in the print cartridge. The ink flow continues as the pressure in the closed system equalizes and ends when the cartridge has been returned to its operating level of ink and its operating pressure of about −2 to −3 inches of water. The vertical displacement of the ink reservoir 19 in the print cartridge as shown in FIG. 2 above the refill ink reservoir 26 reduces the pressure within the closed ink transfer system so that the print cartridge is returned to an operating pressure of less than ambient pressure.

Figure 5:
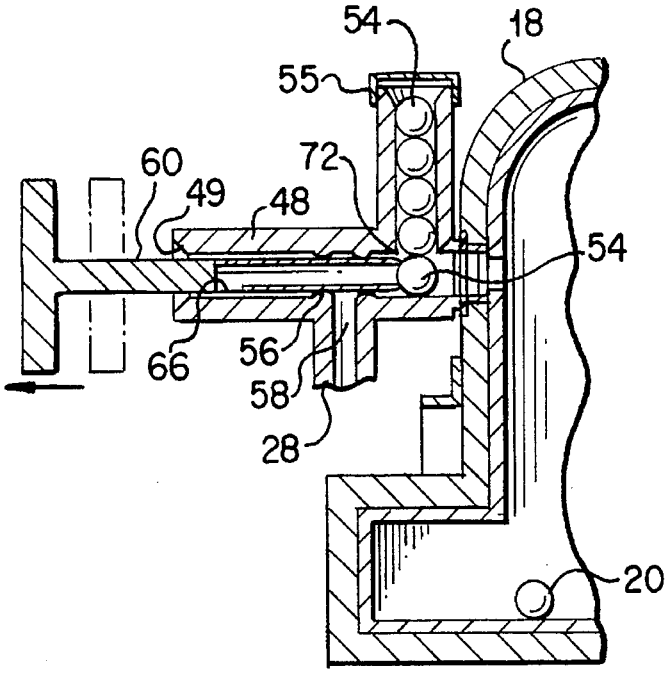

After the ink transfer system has reached equilibrium and the print cartridge has been refilled to its operating level and pressure, the ram 60 is with drawn back away from the print cartridge as illustrated in FIG. 5. The loader 72 of the replacement closure 54 drops it into place in front of the ram while maintaining the closed system pressure. The inlet port 58 and ink conduit 28 are sealed as the side port 66 on the moving ram is sealed by the land 56 in the bore 49 of the hollow cylinder 48.

Figure 6:
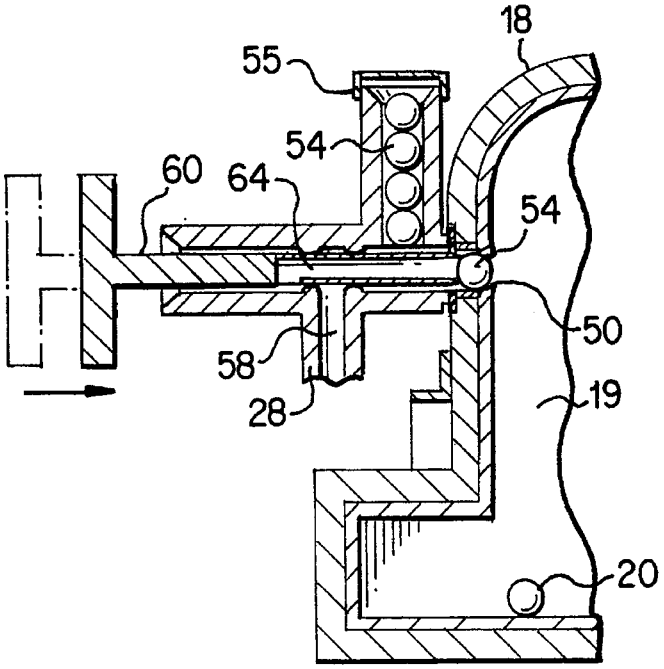

Next, the ram 60 is moved forward toward the print cartridge 18 as illustrated in FIG. 6. This movement seats the replacement closure 54 in the refill port 50 in the side wall of the print cartridge 18. The ink reservoir 19 in the print cartridge is thereby sealed at its operating pressure of between about −2 to −3 inches of water. Thereafter, the print cartridge is removed from that apparatus and is ready for reuse after being refilled.

Although a specific embodiment of the invention has been described and illustrated, the invention is not to be limited to the specific forms or arrangements of parts so described and illustrated. The invention is limited only by the claims.

We claim:

1. An apparatus for refilling a print cartridge with ink, said print cartridge having an ink reservoir at a pressure of less than ambient pressure prior to refilling, comprising:

a) a refill ink reservoir containing ink for refilling, said refill ink reservoir having a pressure therein in excess of the pressure in the ink reservoir of the print cartridge;

b) an ink conduit connected to the refill ink reservoir and connectable to the ink reservoir in the print cartridge;

c) means, connected to the apparatus, for dislocating a first closure for the ink reservoir of the print cartridge by pushing the first closure into the print cartridge and for establishing airtight fluid communication with said ink conduit between the refill ink reservoir and the ink reservoir of the print cartridge so that the print cartridge is automatically refilled by the excess pressure in the refill ink reservoir; and d) means, connected to the apparatus, for closing the ink reservoir of the print cartridge with a second closure, said means for closing the ink reservoir preventing ambient air from entering said ink reservoir after refilling the print cartridge with ink and after the apparatus is removed from the print cartridge.

2. The apparatus of claim 1 further including a locating fixture for the print cartridge so that during refilling the refill ink reservoir is located a predetermined distance below the ink reservoir in the print cartridge so that the print cartridge is refillable by the excess pressure in the refill ink reservoir but to an operating pressure of less than ambient pressure.

3. The apparatus of claim 1 wherein the ink reservoir in the print cartridge prior to refilling has a pressure of between about −7" to −9" of water, the pressure in the refill ink reservoir is about ambient pressure, and the ink reservoir in the print cartridge after refilling has a pressure of between about −2" to −3" of water.

4. An apparatus for refilling a print cartridge with ink, said print cartridge having an ink reservoir at a pressure of less than ambient pressure prior to refilling, comprising:

a) a refill ink reservoir containing ink for refilling, said refill ink reservoir having a pressure therein in excess of the pressure in the ink reservoir of the print cartridge;

b) an ink conduit connected to the refill ink reservoir and connectable to the ink reservoir in the print cartridge for establishing airtight fluid communication between the refill ink reservoir and the ink reservoir of the print cartridge;

c) a reciprocally movable ram for dislocating and reseating closures for the ink reservoir in the print cartridge while sealed against ambient pressure, the movable ram also fluidically coupling said ink conduit to the ink reservoir in a first position after dislocating a closure for the ink reservoir;

d) a magazine for one or more replacement closures; and e) a loader connected to the ram and the magazine for positioning said closures before the ram while sealed against ambient pressure.

5. The apparatus of claim 4 further including a fluid containing wiper connected to the apparatus for cleaning the print cartridge after refilling.

6. A process for refilling a print cartridge with ink, said print cartridge having an ink reservoir at a pressure of less than ambient pressure prior to refilling, comprising the steps of:

a) removing a closure for the ink reservoir, by pushing the closure into the ink reservoir, while preventing ambient air from entering the ink reservoir;

b) establishing fluid communication between a refill ink reservoir and the ink reservoir in the print cartridge with an ink conduit while isolating the refill ink reservoir, the reservoir in the print cartridge and the ink conduit from ambient pressure;

c) transferring ink from the refill ink reservoir to the ink reservoir in the print cartridge as a result of said refill ink reservoir having a pressure in excess of the pressure in the ink reservoir in the print cartridge; and d) reclosing the ink reservoir with a replacement closure while preventing ambient air entering said ink reservoir.

7. The process of claim 6 further including the steps of:

a) generating said pressure by utilizing a vacuum in the reservoir in the print cartridge; and b) reducing said pressure by vertically displacing the print cartridge above the refill ink reservoir for a predetermined distance so that the print cartridge is refilled to an operating pressure of less than ambient pressure.

8. The process of claim 6 wherein the ink reservoir in the print cartridge prior to refilling has a pressure of between about −7" to −9" of water, the pressure in the refill ink reservoir is about ambient pressure, and the ink reservoir in the print cartridge after refilling has a pressure of between about −2" to −3" of water.

9. The process of claim 6 including the steps of creating and maintaining an ink transfer system sealed from ambient pressure.

* * * * *